US005842902A

United States Patent [19]

Liff

[11] Patent Number: 5,842,902

[45] Date of Patent: Dec. 1, 1998

[54] MAGNETICALLY PROPELLED PENDULUM TOY

[76] Inventor: Lawrence J. Liff, 12629 N. Tatum Blvd. - Suite 607, Phoenix, Ariz. 85032

[21] Appl. No.: 885,781

[22] Filed: Jun. 30, 1997

[51] Int. Cl.[6] ..... A63H 33/26

[52] U.S. Cl. ..... 446/130; 446/138; 446/485

[58] Field of Search ..... 446/130, 134, 446/135, 133, 129, 485, 138; 40/426; 335/206, 209, 219, 229, 306; 362/802, 809, 811

[56] References Cited

U.S. PATENT DOCUMENTS

| | | | |
|---|---|---|---|
| 4,011,674 | 3/1977 | Jacobson | 446/134 X |
| 4,568,301 | 2/1986 | Hawley, Jr. | 446/134 |
| 4,588,387 | 5/1986 | Swenson | 446/130 |
| 5,290,184 | 3/1994 | Balogh et al. | 446/47 |

*Primary Examiner*—Robert A. Hafer
*Assistant Examiner*—Jeffrey D. Carlson
*Attorney, Agent, or Firm*—Woodling,Krost & Rust

[57] ABSTRACT

A magnetically propelled pendulum toy which includes a base and a toy member at the end of the pendulum and movable relative to the base. One end of the pendulum is connected to the toy member and the other end is connected to an arm that extends above the base so that the toy member can swing back and forth in pendulum fashion. The toy member and/or pendulum is caused to move back and forth because of the action of magnets in the base and in the toy member and switches in the toy member cause lights in the toy member to blink on and off as a function of the pendulum-like movement of the toy relative to the base.

6 Claims, 7 Drawing Sheets

MAGNETICALLY PROPELLED PENDULUM TOY

The present invention relates to a toy which includes a pendulum that swings back and forth relative to a base unit and as it swings back and forth relative to the base unit, lights in the pendulum blink on and off giving a pleasing visual effect. When the pendulum is designed as a spaceship or saucer, it provides an interesting effect to one using the toy.

The toy of the present invention is provided in a construction that illustrates two means of activating and carrying out the blinking visual effects of the lights and, of course, it will be appreciated by those skilled in the art that in place of, or in addition to, the blinking lights the same system can be utilized to operate some audible sound such as music or otherwise.

The drawings accompanying this application illustrate the best mode for carrying out the invention and are briefly described as follows.

Figure 1:
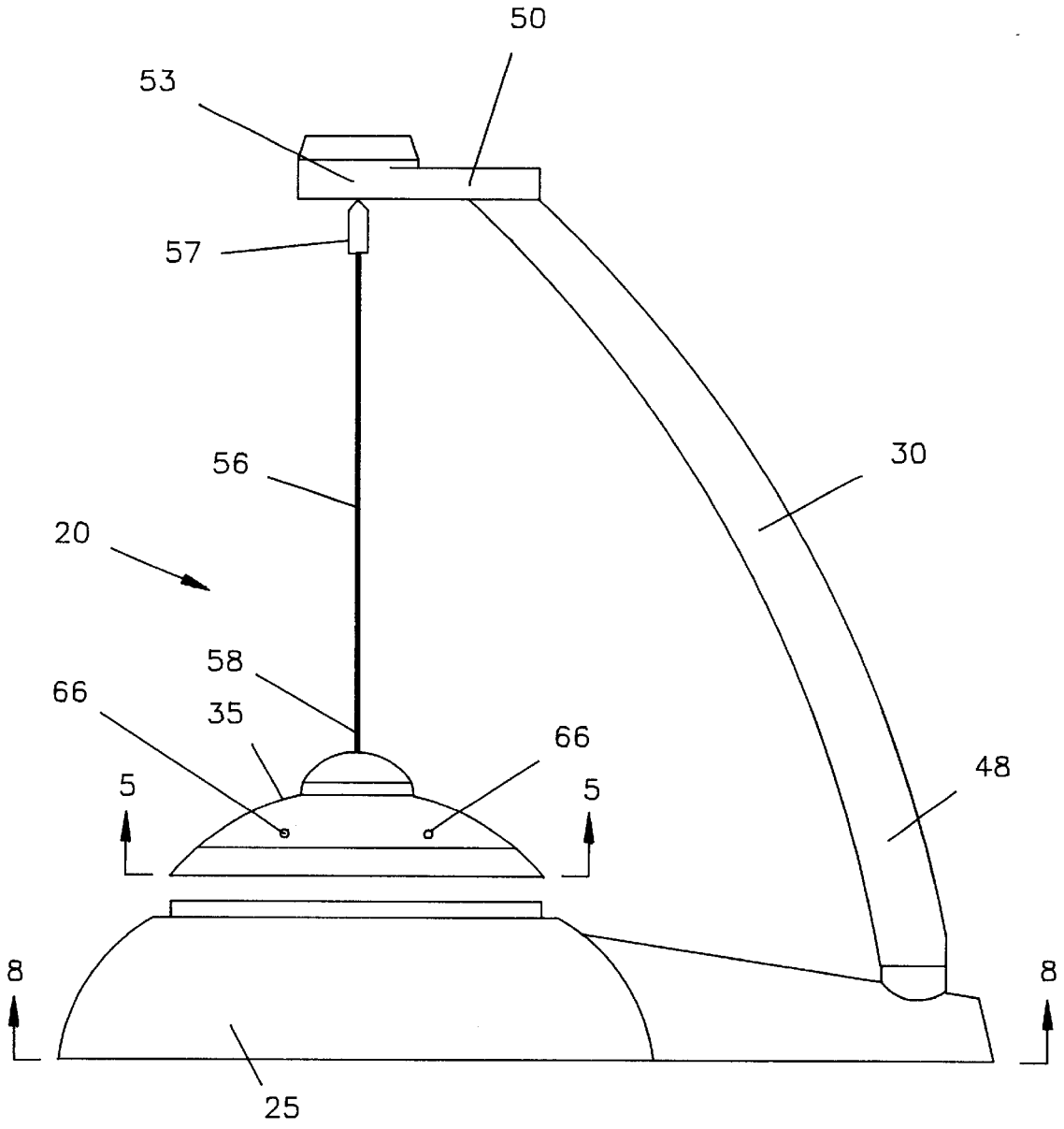
FIG. 1 is a side elevational view of the magnetically propelled pendulum toy of the present invention.
Figure 2:
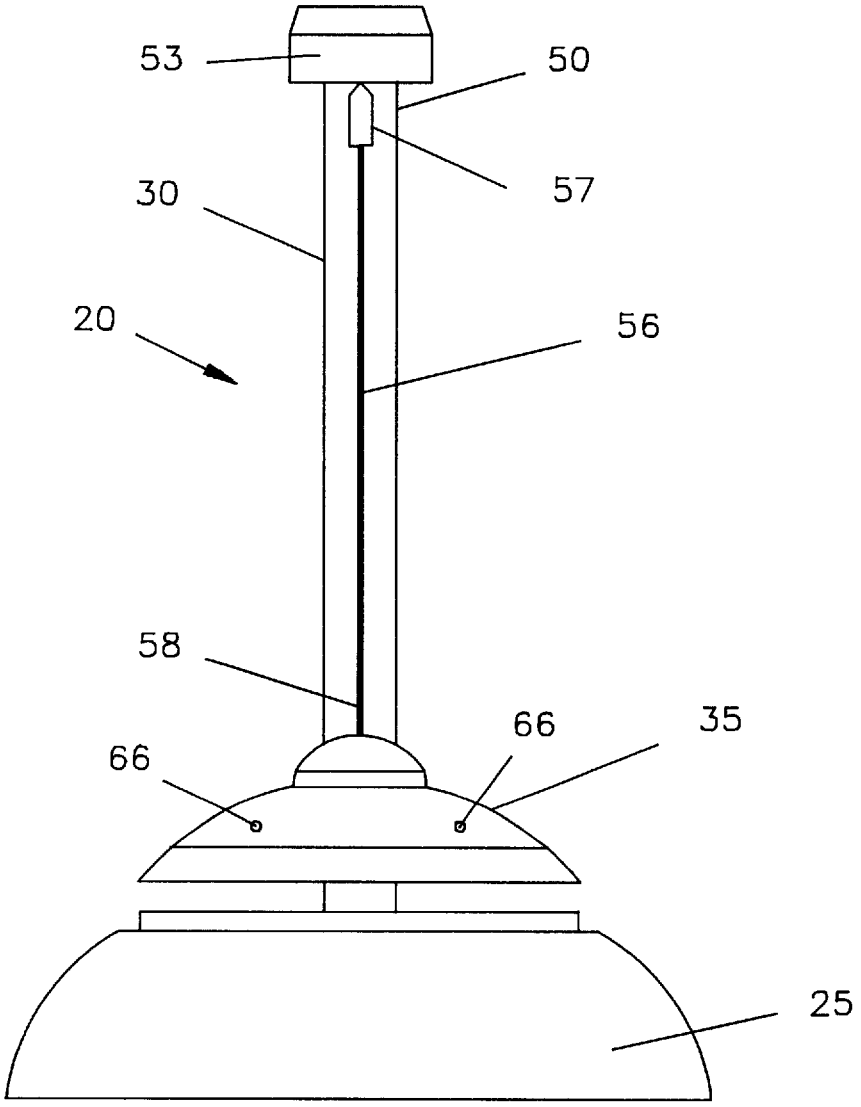
FIG. 2 is an elevational view taken 90° from the position of FIG. 1, or in other words, taken from the left end or left side of FIG. 1.

The magnetically propelled pendulum toy is best illustrated in its overall construction in FIGS. 1 and 2 of the drawings. The toy has been identified generally by the reference numeral 20. The toy 20 includes a base 25, a support arm 30, and a pendulum 35.

Figure 8:
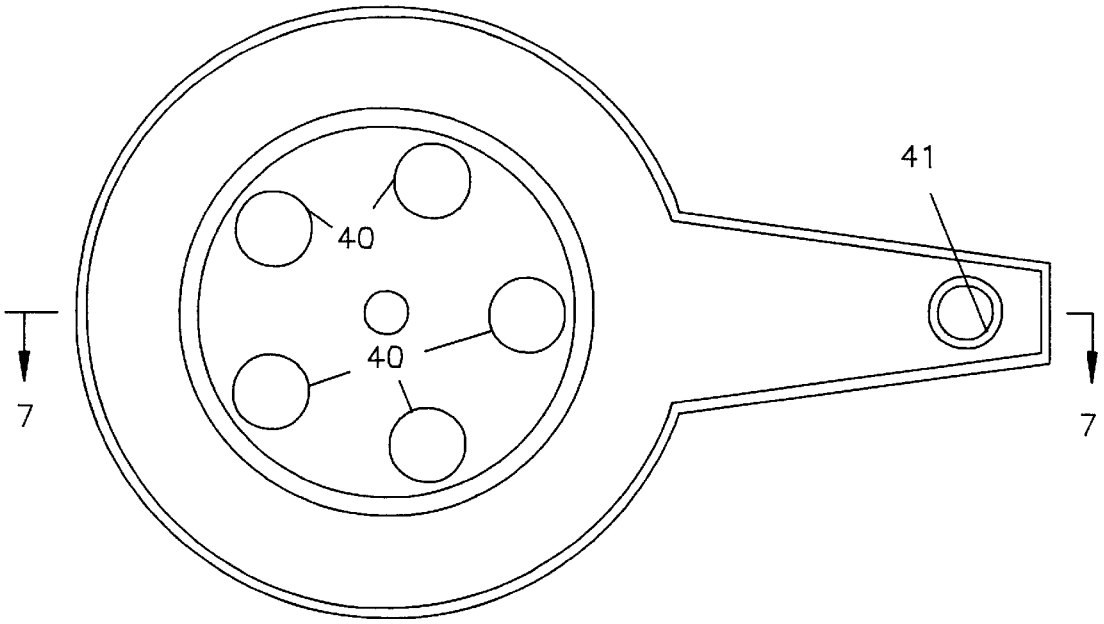
FIG. 8 is a view taken generally along the lines 8—8 of FIG. 1.
Figure 7:
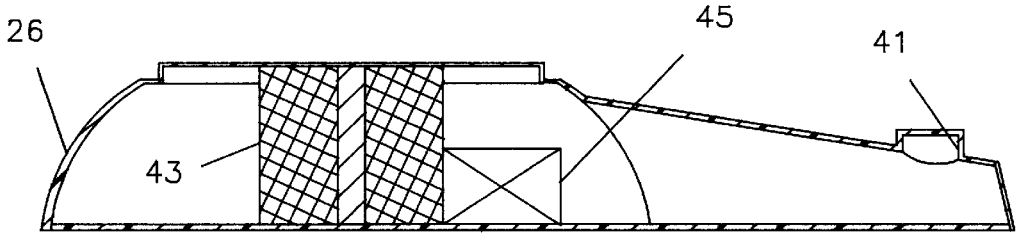
FIG. 7 is a view taken generally along the lines 7—7 of FIG. 8.

The base is best illustrated in FIGS. 7 and 8 and includes a housing 26, somewhat in the form of a shell and mounted in the base illustrated in FIG. 8 are five permanent magnets, each identified by the reference numeral 40. As noted in FIG. 8, these permanent magnets 40 are located in or positioned in an annular configuration in the base. Additionally, there is contained in the base an electrical coil 43 best seen in FIG. 7 which is electrically connected to DC battery 45 which electrically activates the coil.

The support arm 30 has first and second end portions 48 and 50 respectively with the first end portion 48 secured and supported by the base by means of a fixture 41 seen at the right end of the base as illustrated in FIG. 7. The support arm extends upwardly and at its second or upper end portion 50 is provided with a permanent magnet which is referred to herein as a pendulum supporting permanent magnet identified by the reference numeral 53.

A pendulum shaft 56 which has first and second end portions 57 and 58 respectively is provided to connect the pendulum 35 to the base through the support arm 30 so that the pendulum, shaped in this showing as a flying saucer, can swing back and forth relative to the base from its mounting point at the second end portion 50 of the support arm. The first end portion of the shaft is constructed of a magnetized material so that it will connect itself magnetically to the permanent magnet 53 and enable the pendulum to swing back and forth in a universal fashion. Generally speaking the connection between 53 and 57 provides for universal movement relative to the two parts.

Figure 9:
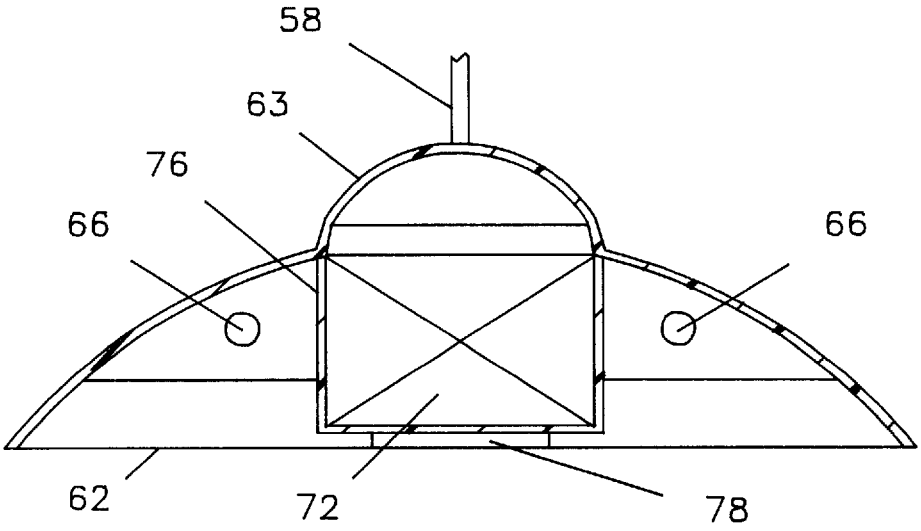
FIG. 9 is a view taken generally along the lines 9—9 of FIG. 5.

The pendulum 35 includes a bottom portion 62 and a top portion 63. The pendulum includes and carries the circuitry of FIG. 3 and the parts as mechanically illustrated in FIG. 5 within the confines of FIG. 9. FIG. 9 does not illustrate all of the components that are found in FIG. 5. It will be seen, however, that the pendulum includes a plurality of spaced lights 66 which are mounted in the top portion 63 which lights are powered by a battery 72 connected to the lights by what has been broadly referred to as an electrical circuit 68.

The electrical circuit 68 illustrates the battery 72 connected through reed switches 75 sometimes referred to herein as magnetically actuated reed switches 75. The reed switches 75 are in parallel with each other and in this parallel circuit each serve to actuate two of the lights 66. The circuit also includes a resistor 73. FIG. 9 illustrates how the battery is supported in the pendulum within a battery compartment 76. The pendulum also includes a permanent magnet 78 positioned as illustrated in FIGS. 5 and 9.

The permanent magnets 40 are positioned in opposition to the permanent magnet 35. By this is meant that the poles of the magnets are positioned so that magnet 35 opposes or repels magnets 40 and vice versa. In other words, if the permanent magnets 40 in the base have their north poles pointing up or at the top of the magnet, then the magnet 78 in the pendulum has its north pole pointing down or at the bottom of the magnet so that the magnets in the base will tend to repel the magnets in the pendulum thereby pushing the pendulum away from the base.

In operation, one using or playing with the toy will manually move the pendulum 35 to one side of the base, for example, viewing FIG. 2 one might pull the pendulum to the left and then let the pendulum swing over the base. As the pendulum by gravity moves over the base, the action of the magnet 78 in the pendulum and the magnets 40 in the base cause the pendulum to keep swinging and sometimes in a somewhat irregular pattern as the pendulum by gravity and the action of the magnet moves over the base. Additionally as the pendulum moves past the base, the magnets in the base cause the magnetically operable switches 75 illustrated in FIG. 3 to move to the closed position which causes the battery 72 to be connected to the lights 66 causing the lights to be illuminated and as the pendulum moves away from the base the magnetically operable switches 75 move to open position causing the lights to turn off or cease to be illuminated. In this fashion as the pendulum swings back and forth across the base, the lights on the saucer turn on and off giving a pleasing and entertaining visual effect. The timing appears to turn the lights off and on as the pendulum swings between a generally 45° angle each way from the position shown in FIG. 2 so that the lights go on and off in the range of from 1/10 of a second to one second. In other words, the lights turn off and on in an interval which is in the range of every 1/10 of a second to every one second.

Figure 3:
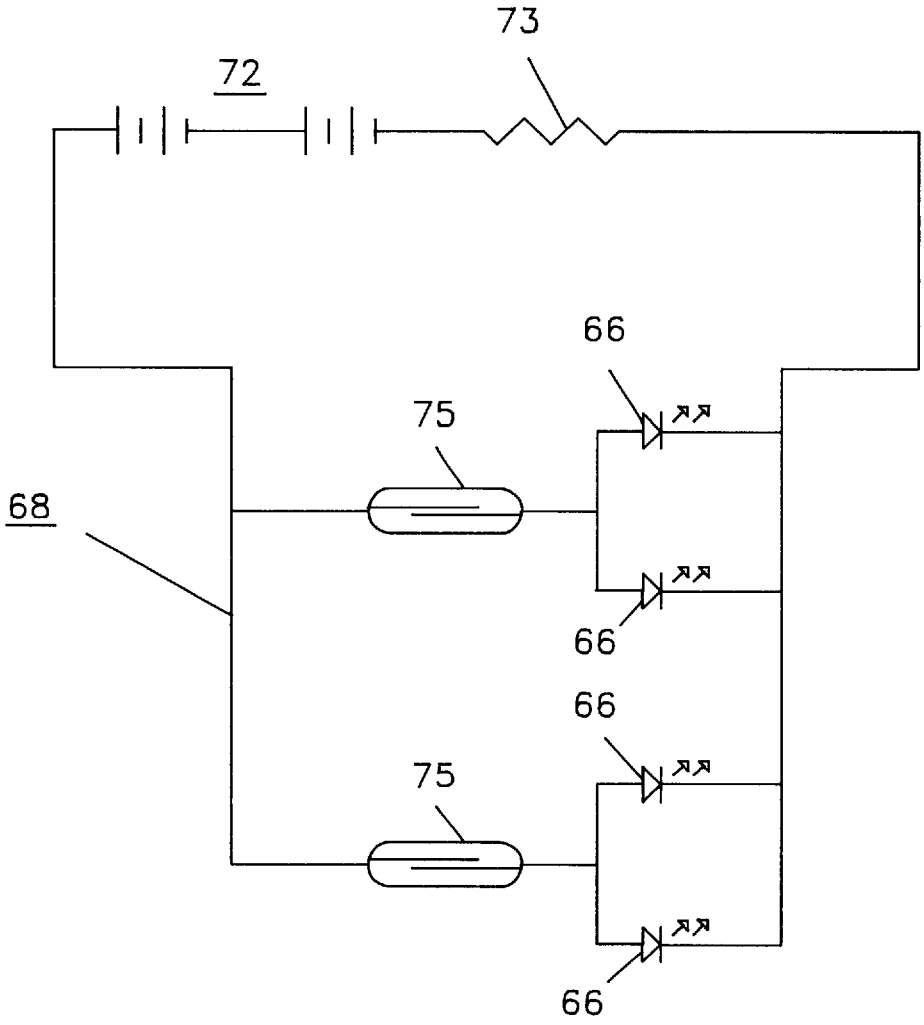
FIG. 3 is an electrical circuit diagram illustrating electrically how one form of the invention functions.
Figure 4:
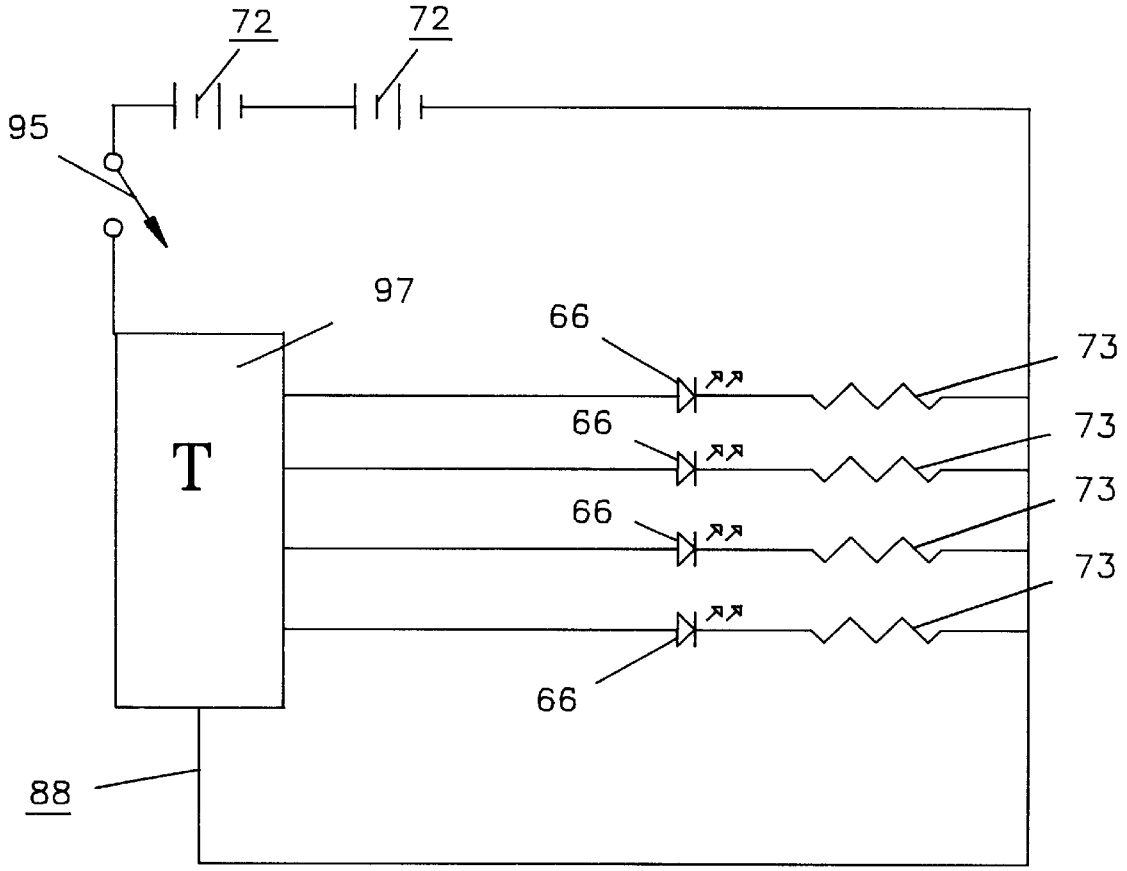
FIG. 4 is a similar electrical circuit diagram to that shown in FIG. 3 illustrating an alternative form of actuating the lights or other visual or audio effects of the invention.
Figure 5:
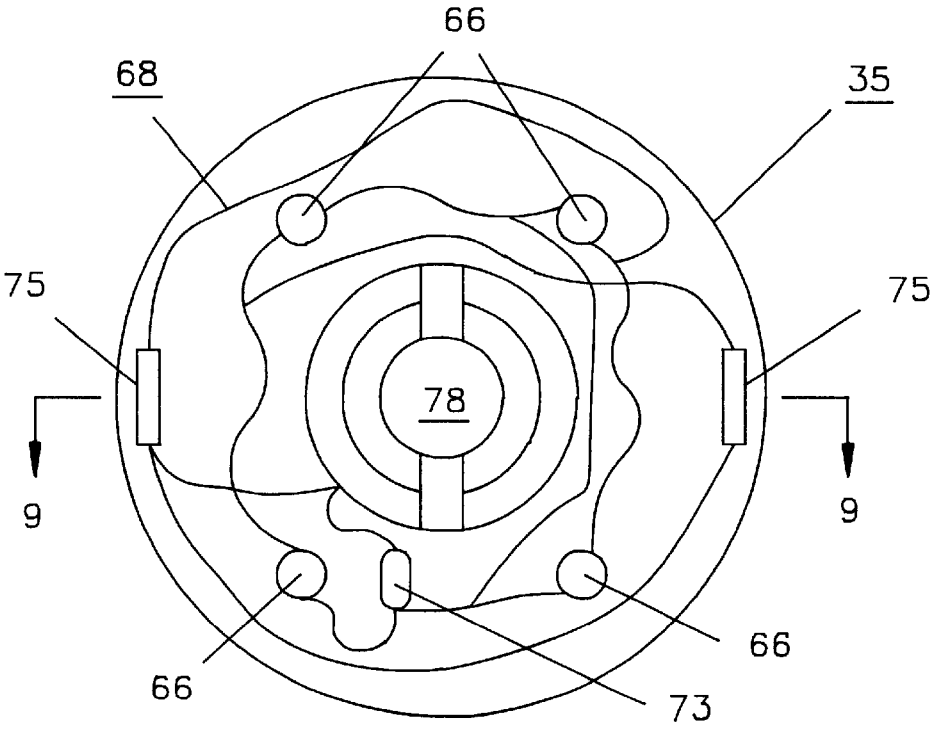
FIG. 5 is a view taken generally along the lines 5—5 of FIG. 1 and illustrating at least portions of the electrical circuit of FIG. 3.
Figure 6:
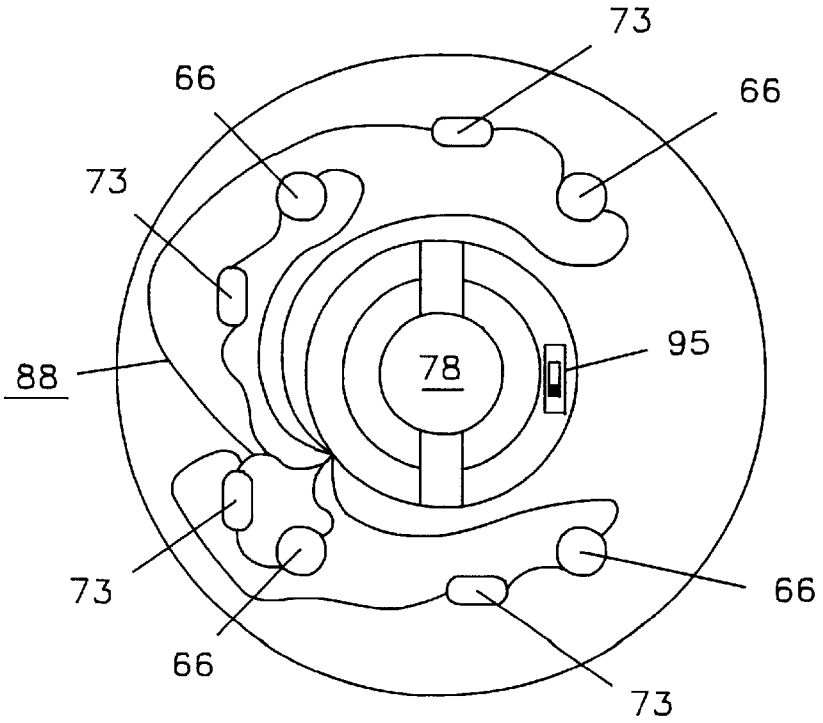
FIG. 6 is a view taken generally along the same line of FIG. 1 as FIG. 5 but illustrating or embodying the electrical circuit illustrated in FIG. 4.

FIGS. 4 and 6 illustrate an alternative form of the invention and where the identical components are used, the same numbers will be used as in describing the device of FIGS. 3 and 5. The electrical circuit of FIGS. 4 and 6 is indicated generally by the reference numeral 88 and as will be noted does not include the reed switches 75. Alternatively it includes a manual switch 95 movable between open and closed positions and a timer 97. This timer is in the form of a small sequencer chip and the manual switch is simply an off and on switch. The timer that is selected for use in the embodiments of FIGS. 4 and 6 is a timer that will open and close the circuit at an interval which is in the range of 1/10 of a second to one second. The embodiment of FIGS. 4 and 6, therefore, is designed so that it approximates the blinking of the lights embodied in the circuitry illustrated in FIGS. 3 and 5 so that the same visual effect is produced.

In the embodiment of FIGS. 4 and 6, the same swinging effect of the pendulum 35 relative to the base 25 is effected in the same way.

The electrical coil 43 found in the base 7 is for the purpose of activating the magnets 40 in the base and keeps the magnets energized for a much longer period of time than if the electrical coil were absent.

It will be really appreciated by those skilled in the art that the lights may be replaced by musical or sound devices in the nature of chips which will produce sound or the two may be used in conjunction with each other. In this disclosure and in the claims, the lights, audible sound and others are referred to as a mechanism carried by the toy member which is capable of manifestations which are observable by the senses of a person observing the toy when the mechanism is activated.

It will thus be seen that there has been disclosed herein a magnetically propelled toy which as the pendulum portion of the same swings relative to the base that lights or other observable manifestations are caused to be effectuated providing a pleasing, interesting and conversation generating device.

The invention has been described in detail with particular emphasis on the preferred embodiments thereof, but it should be understood that variations and modifications within the spirit and scope of the invention may occur to those skilled in the art to which the invention pertains.

What is claimed is:

1. A magnetically propelled pendulum toy containing lights and/or sound including a base, a support arm and a pendulum, said base being generally annular in configuration, a plurality of permanent magnets spaced from each other and positioned in an annular configuration in said base, an electrical coil positioned generally centrally with respect to said plurality of permanent magnets, a battery electrically connected to said electrical coil to provide electrical power thereto, said support arm having first and second end portions, said first end portion being connected to said base and said support arm extending vertically therefrom to a position generally vertically above said base, a pendulum supporting permanent magnet supported by said second end portion of said support arm, a pendulum shaft having first and second end portions, said first end portion of said pendulum shaft being constructed of a magnetized material for attachment of the same to said pendulum supporting permanent magnet, said pendulum having a bottom portion and a top portion, said second end portion of said pendulum shaft being attached to said top portion of said pendulum, a plurality of spaced lights carried by said pendulum, an electrical circuit carried by said pendulum and including an electrical battery to connect same to said plurality of lights, a magnetically actuated switch movable between closed and open positions to selectively illuminate and turn off said lights, a permanent magnet located generally centrally in the bottom portion of said pendulum, swinging of said pendulum over said base causing said magnetically actuated switch to move between closed and open conditions thereby turning said lights on and off and said magnets in said base and said magnet in said bottom portion of said pendulum causing said pendulum to move relative to said base in a back and forth manner.

2. A toy including in combination a base and a toy member movable relative thereto, a support member connected to said toy member and permitting said toy member to move relative to said base in a back and forth fashion, at least a first magnet in said base and at least a second magnet in said toy member with their poles arranged in opposition to each other with said first and second magnets causing movement of said toy member relative to said base, at least one mechanism carried by said toy member capable of manifestations observable by the senses of a person observing the toy when said mechanism is activated, a battery, an electrical circuit connecting said battery to said mechanism through an magnetic switch movable between open and closed positions, said mechanism being activated when said switch is in said closed position, said first and second magnets causing said switch to move between open and closed positions as said toy member moves relative to said base.

3. A magnetically propelled pendulum toy containing lights and/or sound including a base, a support arm and a pendulum, said base being generally annular in configuration, a plurality of permanent magnets spaced from each other and positioned in an annular configuration in said base, an electrical coil positioned generally centrally with respect to said plurality of permanent magnets, a battery electrically connected to said electrical coil to provide electrical power thereto, said support arm having first and second end portions, said first end portion being connected to said base and said support arm extending vertically therefrom to a position generally vertically above said base, a pendulum supporting permanent magnet supported by said second end portion of said support arm, a pendulum shaft having first and second end portions, said first end portion of said pendulum shaft being constructed of a magnetized material for attachment of the same to said pendulum supporting permanent magnet, said pendulum having a bottom portion and a top portion, said second end portion of said pendulum shaft being attached to said top portion of said pendulum, a plurality of spaced lights carried by said pendulum, an electrical circuit carried by said pendulum and including an electrical battery to connect same to said plurality of lights, a timer in said electrical circuit, a manually actuated switch movable between closed and open positions to selectively energize and deenergize said electrical circuit, said timer alternately turning said lights off and on when said manually actuated switch is in said closed position, a permanent magnet located generally centrally in the bottom portion of said pendulum, swinging of said pendulum over said base causing said magnets in said base and said magnet in said bottom portion of said pendulum to cause said pendulum to move relative to said base in a back and forth manner.

4. A toy as claimed in claim 3 wherein said timer turns said lights off and on once every 0.1 second to once every 1.0 second.

5. A magnetically propelled pendulum toy containing lights and/or sound including a base, a support arm and a pendulum, permanent magnets spaced from each other and positioned in said base, said support arm having first and second end portions, said first end portion being connected to said base and said support arm extending vertically therefrom to a position generally vertically above said base, a pendulum shaft having first and second end portions, said first end portion of said pendulum shaft being connected to said second end portion of said support arm, said pendulum having a bottom portion and a top portion, said second end portion of said pendulum shaft being attached to said top portion of said pendulum, a plurality of spaced lights carried by said pendulum, an electrical circuit carried by said pendulum and including an electrical battery to connect same to said plurality of lights, a timer in said electrical circuit, a manually actuated switch movable between closed and open positions to selectively energize and deenergize said electrical circuit, said timer alternately turning said lights off and on when said manually actuated switch is in said closed position, a permanent magnet located generally centrally in the bottom portion of said pendulum, swinging of said pendulum over said base causing said magnets in said base and said magnet in said bottom portion of said pendulum to cause said pendulum to move relative to said base in a back and forth manner.

6. A toy as claimed in claim 5 wherein said timer opens and closes said electrical circuit when said manually operable electrical switch is in the closed position with said opening and closing of said electrical circuit occurring in the range of once every 0.1 to 1.0 second.

* * * * *